US007682154B2

(12) United States Patent
Hojo et al.

(10) Patent No.: US 7,682,154 B2
(45) Date of Patent: Mar. 23, 2010

(54) BALANCE PRACTICING MACHINE

(75) Inventors: Hiroyuki Hojo, Hikone (JP); Ryusuke Nakanishi, Nagoya (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 581 days.

(21) Appl. No.: 10/758,019

(22) Filed: Jan. 16, 2004

(65) Prior Publication Data

US 2004/0166938 A1 Aug. 26, 2004

(30) Foreign Application Priority Data

Jan. 17, 2003 (JP) ..... 2003-010291

(51) Int. Cl.
*A63B 69/04* (2006.01)
*A63G 31/00* (2006.01)

(52) U.S. Cl. ..... 434/247; 472/95

(58) Field of Classification Search ..... 472/95–99, 472/59–61, 135; 434/55, 247
See application file for complete search history.

(56) References Cited

U.S. PATENT DOCUMENTS

| | | | | |
|---|---|---|---|---|
| 2,889,148 | A * | 6/1959 | Lyles | 472/97 |
| 3,672,075 | A * | 6/1972 | Eikelenboom | 434/247 |
| 4,957,444 | A * | 9/1990 | Armen | 434/247 |
| 4,988,300 | A * | 1/1991 | Yamaguchi et al. | 434/247 |
| 5,180,338 | A * | 1/1993 | Pinto | 472/96 |
| 5,429,515 | A * | 7/1995 | Greenwood | 434/247 |
| 5,787,692 | A | 8/1998 | Purdy | |
| 6,059,666 | A * | 5/2000 | Ohara et al. | 472/97 |
| 6,210,167 | B1 * | 4/2001 | Nishiyama | 434/247 |
| 6,332,307 | B1 * | 12/2001 | Friedson | 54/44.6 |
| 6,378,278 | B1 | 4/2002 | Talbot | |
| 6,402,626 | B1 * | 6/2002 | Beaty | 472/96 |
| 6,808,458 | B1 * | 10/2004 | Jung | 472/97 |
| 6,835,141 | B2 * | 12/2004 | Eaves | 472/97 |

FOREIGN PATENT DOCUMENTS

| | | |
|---|---|---|
| DE | 2259376 | 6/1974 |
| EP | 0963767 | 12/1999 |
| JP | 2000-210391 | 8/2000 |
| JP | 2001-079113 | 3/2001 |
| JP | 2001-286578 | 10/2001 |
| WO | 97/29815 | 8/1997 |
| WO | 98/32501 | 7/1998 |
| WO | 01/93961 | 8/2002 |

OTHER PUBLICATIONS

English Language Abstract of JP 2001-286578.
English Language Abstract of JP 2001-079113.
English Language Abstract of JP 2000-210391.

* cited by examiner

*Primary Examiner*—Kien T Nguyen
(74) *Attorney, Agent, or Firm*—Greenblum & Bernstein, P.L.C.

(57) ABSTRACT

A balance practicing machine that provides effective balancing practice through the compound movement of an adjustable seat that comfortably accommodates various body types. The balance practicing machine is equipped with a saddle-shaped seat upon which a user sits, a drive unit that imparts a swinging motion to the seat, expandable and contractible elements on the surface of the seat, and a mechanism to expand and contract the expandable and contractible elements.

22 Claims, 5 Drawing Sheets

BALANCE PRACTICING MACHINE

BACKGROUND OF THE INVENTION

1. Field of the Invention

The present invention relates to a balance practicing machine used to practice balancing the body and to provide exercise for the user.

2. Description of Related Art

It is generally known that the act of riding a horse must be practiced in order to learn balance, prevent falling, and to exercise the muscles of the back which will prevent lower back pain. However, locations where horses can be ridden are limited. A machine has been disclosed which provides the same type of movement encountered when riding a horse, thus making it possible to practice balancing without the restrictions of location and weather associated with actual horseback riding.

The type of balance practicing machine of the related art is equipped with a seat in the form of a saddle on which the user sits, and a drive mechanism that imparts a swinging motion to the seat. As a result of the drive mechanism conveying a swinging motion to a seat straddled by the user, the user is able to practice balancing while obtaining the benefits of increased strength of the lower back and thigh muscles and more flexible hip joints. Japanese Laid Open Patent 2001-286578 discloses an example of a related art balance practicing machine in which the drive mechanism that conveys a swinging motion to a seat is provided within a pedestal and can, for example, include a motor as the power source and a motion conversion device that converts the rotation of the motor to the swinging motions conveyed to the seat. The drive mechanism is connected to a control panel and controlled therefrom. The drive mechanism imparts three degrees of freedom of movement of the seat in the form of a longitudinal or forward reciprocating linear motion and reciprocating pivoting motions around the longitudinal (fore and aft) and transverse axes.

In the related art, due to the seat of the balance practicing machine being of fixed dimensions, there are cases where the size of the seat does not comfortably accommodate the body type of the person sitting on it. Also, the drive mechanism imparts only a swinging motion to the seat during use which, in itself, cannot provide effective balancing practice, does not sufficiently strengthen the lower back or thigh muscles, and does not adequately create more flexibility in the hip joints.

SUMMARY OF THE INVENTION

In order to improve the balance practicing machines of the related art, the present invention includes a balance practicing machine that provides more effective balancing practice by allowing adjustment of the size of the seat in order to comfortably accommodate the user's body type, and by imparting a compound motion to the seat when the machine is in use.

In order to improve upon the related art, the present invention provides a balance practicing machine that includes a saddle-shaped seat upon which a user sits, a drive mechanism that imparts a swinging motion to a seat, expandable and contractible members attached to a seating surface of the seat, and a mechanism to expand and contract the expandable and contractible members.

In the present invention, the installation of the expandable and contractible members to the seating surface of the seat, and the provision of the mechanism to expand and contract the expandable and contractible members, enable the user to adjust the amount of expansion and contraction and thus change the size of the seat to more comfortably accommodate his or her body type. Also, a more complex compound motion can be obtained if the repeated expansion and contraction of the expandable and contractible members is combined with the swinging motion of the seat.

The balance practicing machine of the present invention also includes expandable and contractible members located at positions opposed to the thighs and knees of the user who sits on the seating surface.

By providing the expandable and contractible members at locations opposing the thighs and knees of the user sitting on the seat, it becomes possible to adjust the width of the seat, by changing the volume of expansion or contraction of the expandable and contractible members, to comfortably accommodate the body type of the user. Repeated expansion and contraction of the expandable and contractible members, during the time when the balance practicing machine is in use, has the effect of changing the shape of the expandable and contractible members which in turn imparts an uplifting motion to the thighs of the user to open and close the hip joints, thus strengthening the thigh muscles and making the hip joints more flexible.

The balance practicing machine of the present invention additionally includes an elevator mechanism which is provided in the balance practicing machine to raise and lower the seat.

By providing the balance practicing machine of the present invention with an elevator mechanism to raise and lower the seat, it becomes possible to adjust the height of the seat to a position that comfortably accommodates the body type of the user. Also, the repeated raising and, lowering of seat, while the balance practicing machine of the present invention is operating, can be combined with the swinging motion of the seat and the expansion and contraction of the expandable and contractible members to obtain a more complex compound motion.

An aspect of the present invention provides a balance practicing machine including a seat on which a user sits; a drive mechanism that imparts a swinging motion to the seat; an expandable and contractible member provided on a seating surface of the seat; and a mechanism that expands and contracts the expandable and contractible member. Further, the seat may have a saddle shape; and the expandable and contractible member may be positioned to oppose the thighs and knees of the user when the user sits on the seat. The expandable and contractible member may include a first expandable and contractible element and a second expandable and contractible element, and the first and second expandable and contractible elements may be positioned on opposite sides of the seat. Further, the first and second expandable and contractible elements may be positioned to oppose the thighs and knees of the user when the user sits on the seat; and the first and second expandable and contractible elements may expand and contract in substantially opposite directions. Additionally, the first and second expandable and contractible elements may be positioned to oppose the thighs and knees of the user when the user sits on the seat, so that the user's hip joints open and close when the first and second expandable and contractible elements expand and contract, respectively. Further, the first and second expandable and contractible elements may include a first air bladder and a second air bladder, respectively; and an air supply unit may supply air to the first and second air bladders.

According to a further aspect of the present invention, the expandable and contractible member provides adjustability of size of the seat to accommodate a particular user's body type. Further, the expandable and contractible member may be repeatedly expanded and contracted during operation of the drive mechanism to provide compound motion to the seat.

In a further aspect of the present invention, an elevator mechanism is provided to raise and lower the seat. Further, the elevator may provide adjustability of the height of the seat. The elevator may be repeatedly raised and lowered during operation of the drive mechanism to provide compound motion to the seat.

A further aspect of the present invention provides a balance practicing machine including a seat; a drive mechanism that imparts a swinging motion to the seat; and a moving device that is repeatedly actuated during operation of the drive mechanism to provide compound motion to the seat.

BRIEF DESCRIPTION OF THE DRAWINGS

The above, and other objects, features and advantages of the present invention will be made apparent from the following description of the preferred embodiments, given as non-limiting examples, with reference to the accompanying drawings in which.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

Figure 1:
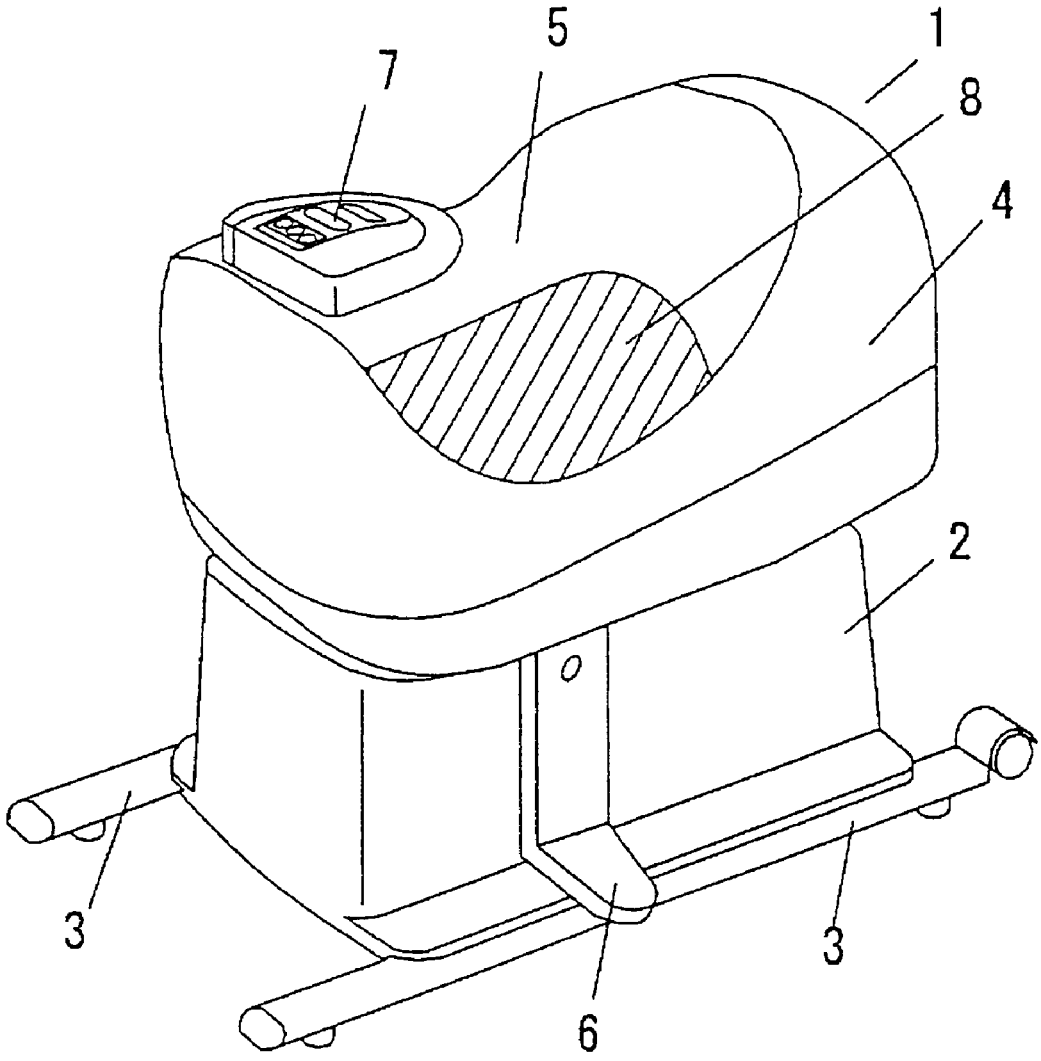
FIG. 1 is a perspective view of the balance practicing machine according to a first embodiment of the present invention.
Figure 2:
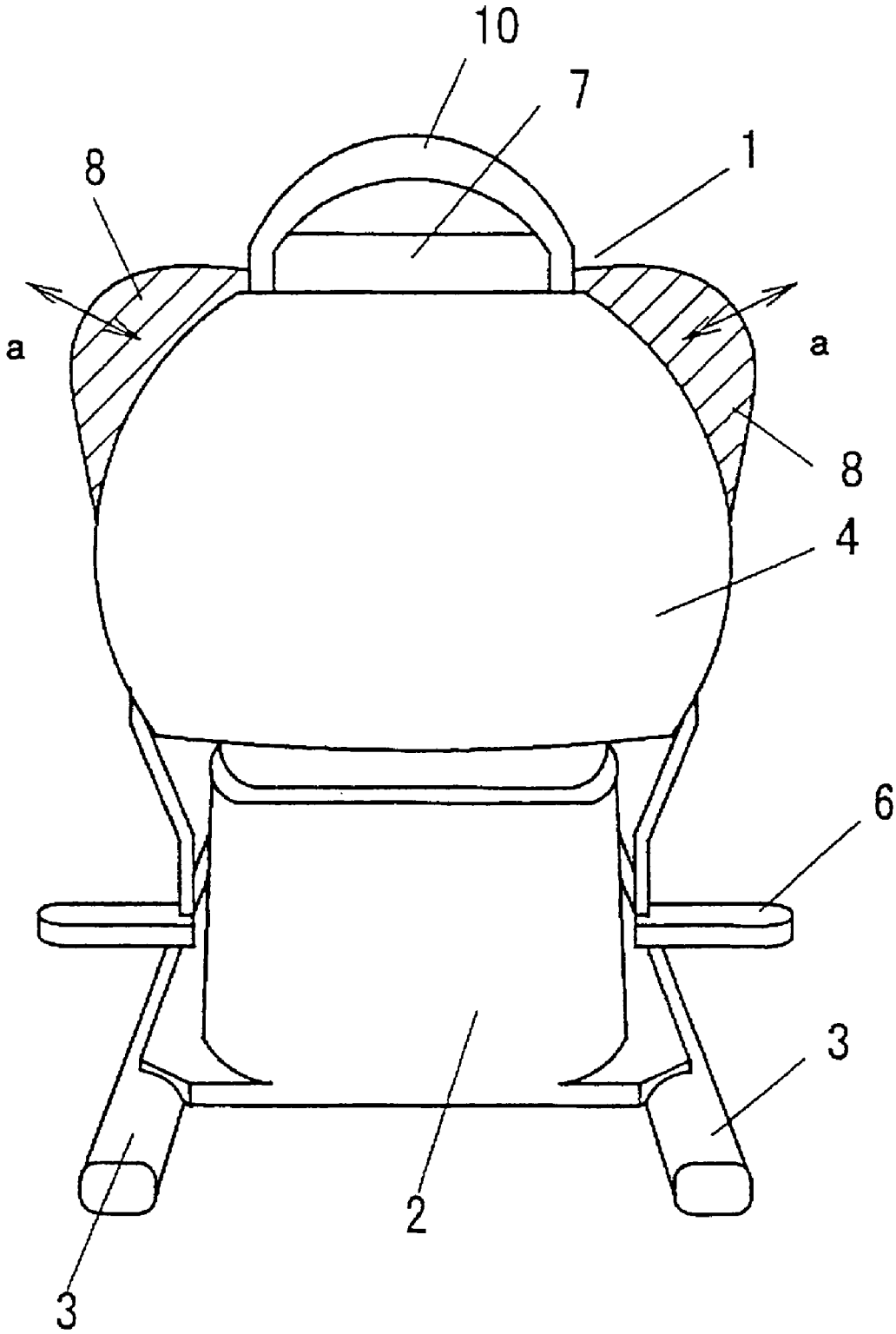
FIG. 2 is a perspective view from the front of the balance practicing machine of the embodiment of FIG. 1.
Figure 3:
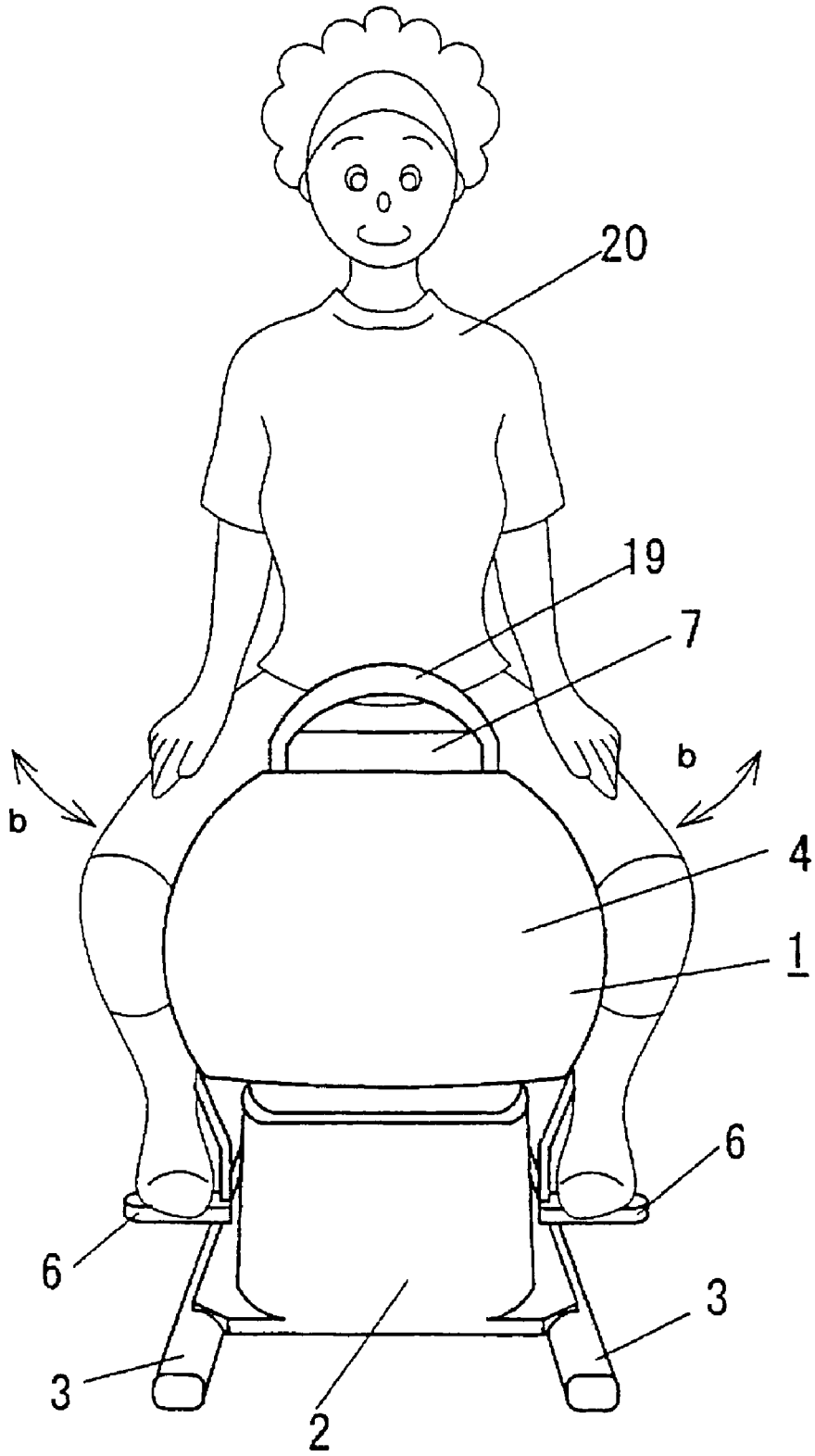
FIG. 3 is a perspective view from the front of the balance practicing machine of the embodiment of FIG. 1 with a person sitting on the seat.

The following will describe a first embodiment of the present invention with reference to the attached drawings. FIGS. 1 through 3 illustrate a balance practicing machine 1. Support legs 3 are provided to stabilize pedestal 2 via a horizontally oriented (in the left to right direction as viewed in FIG. 2) floor plate attached to the lower end of pedestal 2. Saddle-shaped seat 4, on which a user 20 sits, is formed on the upper surface of pedestal 2.

Seating surface 5, which is formed on the upper surface of seat 4 as an approximately U-shaped surface (when viewed from above) upon which user 20 sits, contacts the buttocks, rear and inner parts of the thighs, and inner side of the knees of user 20. The front portion of seating surface 5, that is, the part that comes into contact with the rear and inner sides of the thighs and the inner sides of the knees, has outer parts that are inclined downwardly as they extend in the transverse direction. The rear portion of seating surface 5, that is, the part that comes into contact with the user's buttocks, is inclined upwardly as it extends rearward. Furthermore, control panel 7 is provided at the forward central portion of the upper surface of seat 4. Stirrups 6, onto which the user 20 sitting on the seat 4 places his or her feet, extend downwardly from the lower left and right sides of seat 4, and are able to rotate freely around the horizontal axis. Stirrups 6 may be omitted if desired. Also, as shown in FIG. 2, a grip 10 may be provided on the seat 4.

The drive mechanism (not shown in the figures) that conveys a swinging motion to seat 4 is provided within pedestal 2 and can, for example, include a motor as the power source and a motion conversion device that converts the rotation of the motor to the swinging motions conveyed to seat 4. The drive mechanism is connected to control panel 7 and controlled therefrom. While the drive mechanism may provide three degrees of freedom of movement to seat 4 in the form of a longitudinal (forward and back) reciprocating linear motion and reciprocating pivoting motions around the fore-aft (longitudinal) and transverse axes, the motions provided are not limited to these noted motions only. Balance practicing machine 1, which is equipped with seat 4 and a drive mechanism as described above, is able to employ, for example, the known drive system described in Japanese Kokai Patent 2001-286578; or the balance practicing machine 1 of the present invention may include an alternative drive system that provides three degrees of freedom of movement to seat 4 in the form of a longitudinal (forward and back) reciprocating linear motion and reciprocating pivoting motions around the fore-aft (longitudinal) and transverse axes.

To operate balance practicing machine 1, user 20 straddles seating surface 5 of seat 4 as shown in FIG. 3, and controls the motion, including the swinging motion of seat 4, which is driven by the drive mechanism, through control panel 7. User 20 is thus able to practice balancing while obtaining the benefits of strengthened lower back and thigh muscles, and more flexible hip joints.

Because the seat of the balance practicing machine of the related art explained above is made to fixed dimensions, there are cases where the size of the seat will not comfortably accommodate the body shape of a user. Also, the drive mechanism of the related art balance practicing machine conveys only a swinging movement to the seat which is, in itself, not capable of providing effective balancing practice. Therefore, balance practicing machine 1 of the present invention is equipped with expandable and contractible members on seating surface 5 of seat 4 as well as a mechanism to expand and contract the expandable and contractible members.

To explain further, the expandable and contractible members are provided in the form of expandable and contractible air bladders 8 (shown as the hatched portions of FIGS. 1 and 2) to the parts of seating surface 5 of seat 4 that oppose the thighs and knees of user 20, that is, the forward portions of seating surface 5 that are in contact with the inner and rear part of the thighs and the inner sides of the knees. As shown by arrows 'a' in FIG. 2, air bladders 8 can expand and contract in directions directly opposed to the front portion of seating surface 5. As a result of the expansion and contraction of air bladders 8, the thighs and knees of user 20 can be moved in the directions of arrows 'b' in FIG. 3, that is, in the directions in which the hip joints of user 20 open and close.

The mechanism that expands and contracts the air bladders 8 (expandable and contractible members) can, for example, be provided in the form of an air supply unit (not shown in the Figures) provided within pedestal 2. The air supply unit expands bladders 8 by pumping air therein, and contracts bladders 8 by removing air therefrom. The air supply unit is connected to and controlled by the operation of control panel 7.

As the previously described embodiment of balance practicing machine 1 is equipped with expandable and contractible members on seating surface 5 of seat 4 and a mechanism to expand and contract the expandable and contractible members, user 20 is able to adjust the amount of expansion and contraction of the expandable and contractible members by operating the air supply unit through control panel 7, and thus adjust the size of seat 4 to comfortably accommodate his or her body type. Furthermore, a complex motion can be attained when the machine is operating by combining the swinging motion of seat 4 with repeated expansion and contraction of the expandable and contractible members, thus creating a motion that provides more effective balancing practice and physical exercise.

Furthermore, because the first embodiment of the present invention provides for the expandable and contractible members being provided on seating surface 5 at locations opposing the thighs and knees of user 20, the amount of expansion and contraction of the expandable and contractible members can be adjusted through the operation of control panel 7, thus allowing the width of seat 4 to be changed to comfortably accommodate the body type of user 20. Moreover, while the balance practicing machine is being used, the shape of the expandable and contractible members can be changed by their repeated expansion and contraction to create a motion that raises the thighs to open and close the hip joints, the result being that the thigh muscles are strengthened and hip joints are made more flexible.

The first embodiment of the present invention is not limited solely to the use of expandable and contractible members of the type embodied by air bladders 8, nor to the use of an air supply unit to expand and contract the expandable and contractible members.

Furthermore, because the height of seat 4 from the floor is a fixed dimension in the first embodiment, a user 20 having relatively long legs may find that his or her legs reach the floor when sitting on the seat, thus preventing effective use of the machine. Also, in cases where user 20 is a physically handicapped person, he or she may find it difficult to mount and dismount the machine due to the relatively high location of seat 4. In order to adapt to this situation, the following will describe a further embodiment of the invention that differs from the previously described first embodiment. Structures shared by both embodiments of the present invention are identified by the same element numbers, and descriptions of previously explained structures and functions shared by both embodiments have been omitted.

Figure 4:
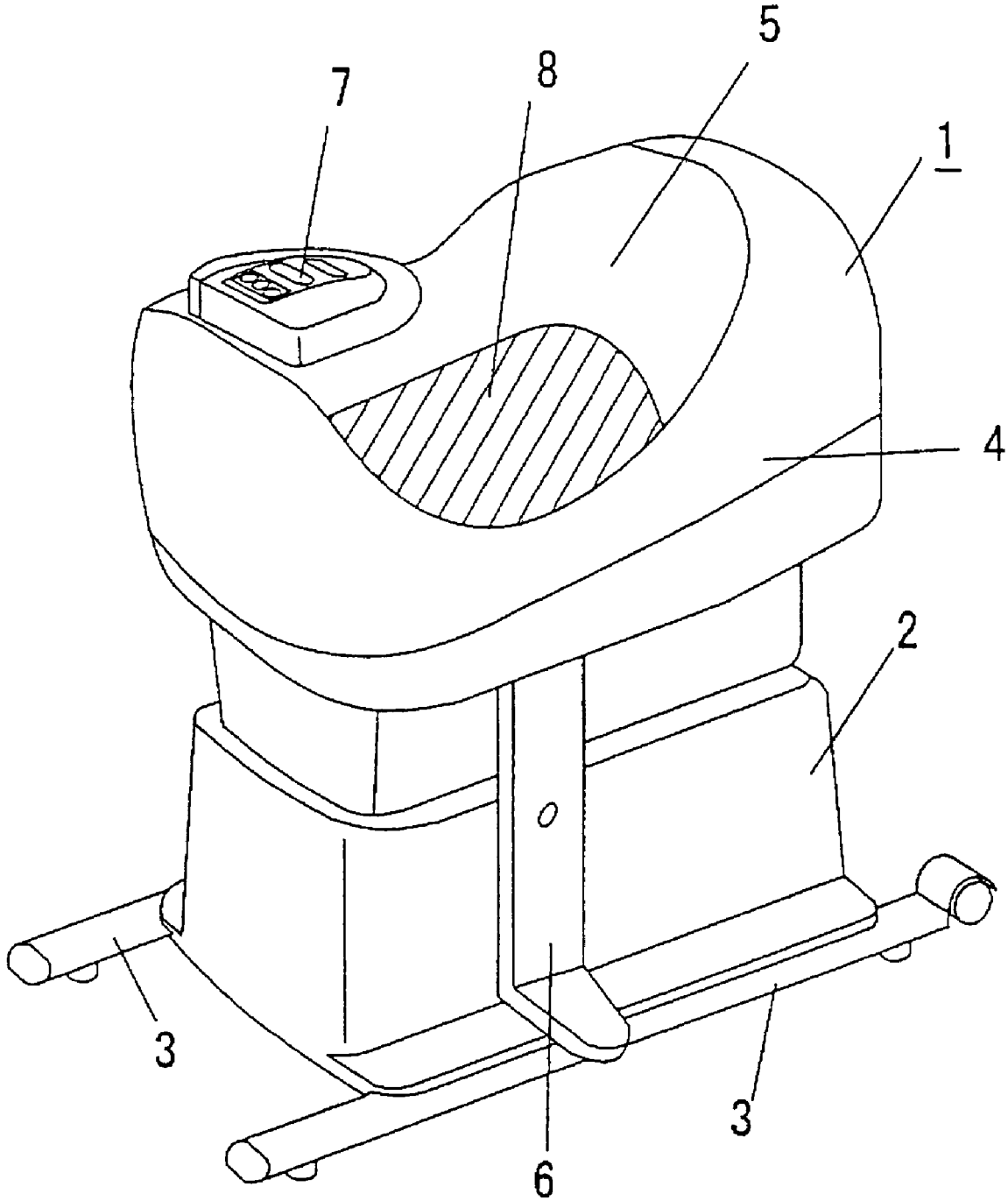
FIG. 4 is a perspective view of a balance practicing machine according to a second embodiment of the present invention.
Figure 5:
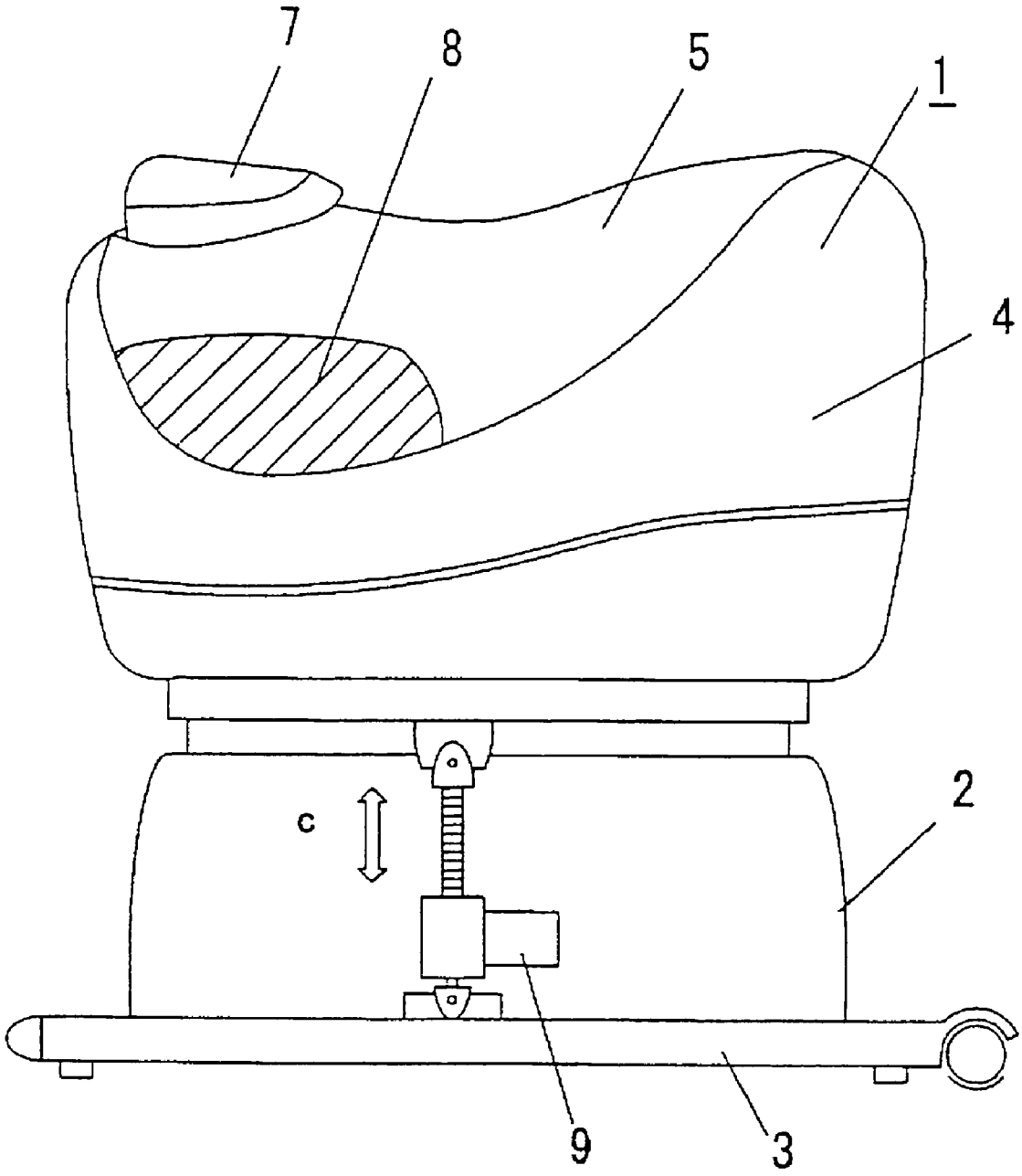
FIG. 5 is a side view of the balance practicing machine of the embodiment of FIG. 4 with a portion thereof cut out for illustrative purposes.

FIGS. 4 and 5 describe a second embodiment of the present invention in the form of balancing practice machine 1 equipped with elevator mechanism 9 that raises and lowers seat 4. As shown in FIG. 5, pedestal 2 may be incorporated with elevator mechanism 9 which is able to extend and retract in the vertical direction shown by arrow 'c'. Elevator mechanism 9 may include an electric motor driven device, or a hydraulic jacking mechanism such as a gas spring. Elevator mechanism 9 is connected to and controlled by the control panel 7.

As a result of elevator mechanism 9 being provided to balance practicing machine 1 in order to raise and lower seat 4, the height of seat 4 can be adjusted through the operation of control panel 7, thus allowing seat 4 to be placed at a height that comfortably accommodates user 20. For example, if user 20 is a person with long legs, seat 4 can be adjusted to a height that keeps the user's legs off of the ground. If user 20 is a handicapped person, seat 4 can be lowered to allow the person to comfortably mount and dismount the machine. Furthermore, by repeatedly raising and lowering the position of seat 4 while user 20 is sitting on the seat with the machine operating, a compound motion can be obtained as a combination of the swinging movement of seat 4, the expansion and contraction of the inflatable bladders, and the repeated raising and lowering of seat 4. This type of compound motion is able to provide an even more effective type of balancing practice and physical exercise.

The invention includes expandable and contractible members located on the seating surface of the seat, and a mechanism to expand and contract the expandable and contractible members, thus allowing the user to adjust the volume of expansion and contraction of the expandable and contractible members as means of changing the size of the seat to match his or her body type. Furthermore, by combining the repeated expansion and contraction of the expandable and contractible members with the swinging motion of the seat, a compound motion can be obtained that provides more effective practice and physical exercise.

Furthermore, the invention may include expandable and contractible members at locations opposing the thighs and knees of the person sitting on the seat, the adjustable expansion and contraction of the expandable and contractible members enabling the width of the seat to be adjusted to comfortably accommodate various body types. Moreover, the repeated expansion and contraction of the expandable and contractible members, while the machine is being used, imparts an uplifting motion to the thighs that opens and closes the hip joints, thus resulting in strengthened thigh muscles and more flexible hip joints.

Moreover, in addition the invention may include an elevator mechanism that adjustably raises and lowers the seat in order to accommodate the body types of various persons. Furthermore, by repeatedly raising and lowering the position of the seat while the balance practicing machine is in use, a compound motion can be obtained as a combination of the swinging movement of the seat, the expansion and contraction of the inflatable bladders, and the repeated raising and lowering of the seat. This type of compound motion provides an even more effective type of balancing practice and physical exercise.

Although the invention has been described with reference to an exemplary embodiment, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed. Rather, the invention extends to all functionally equivalent structures, methods, and uses such as are within the scope of the appended claims.

The present disclosure relates to subject matter contained in priority Japanese Application No. 2003-010291, filed on Jan. 17, 2003, which is herein expressly incorporated by reference in its entirety.

What is claimed is:

1. A balance practicing machine comprising:

a seat on which a user sits;

a drive mechanism that imparts a swinging motion to said seat;

an expandable and contractible member provided at a location of said seat corresponding to thighs of the user sitting on said seat; and a mechanism that automatically repeatedly expands and contracts said expandable and contractible member in alternately repeating upwardly-outwardly and downwardly-inwardly directions during operation of the drive mechanism to provide compound motion to the seat.

2. The balance practicing machine according to claim 1, wherein said seat has a saddle shape.

3. The balance practicing machine according to claim 1, wherein said expandable and contractible member is positioned to oppose the thighs and knees of the user when the user sits on said seat.

4. The balance practicing machine according to claim 1, wherein said expandable and contractible member comprises a first expandable and contractible element and a second expandable and contractible element.

5. The balance practicing machine according to claim 4, wherein said first and second expandable and contractible elements are positioned on opposite sides of said seat.

6. The balance practicing machine according to claim 4, wherein said first and second expandable and contractible elements are positioned to oppose the thighs and knees of the user when the user sits on said seat.

7. The balance practicing machine according to claim 4, wherein said first and second expandable and contractible elements expand and contract in substantially opposite directions.

8. The balance practicing machine according to claim 4, wherein said first and second expandable and contractible elements are positioned to oppose the thighs and knees of the user when the user sits on said seat, so that the user's hip joints open and close when said first and second expandable and contractible elements expand and contract, respectively.

9. The balance practicing machine according to claim 4, wherein said first and second expandable and contractible elements comprise a first air bladder and a second air bladder, respectively.

10. The balance practicing machine according to claim 9, wherein an air supply unit supplies air to said first and second air bladders.

11. The balance practicing machine according to claim 1, wherein said expandable and contractible member provides adjustability of size of said seat to accommodate a particular user's body type.

12. The balance practicing machine according to claim 1, wherein an elevator mechanism is provided to raise and lower said seat.

13. The balance practicing machine according to claim 12, wherein said elevator provides adjustability of the height of said seat.

14. The balance practicing machine according to claim 12, wherein said elevator is repeatedly raised and lowered during operation of said drive mechanism to provide compound motion to said seat.

15. The balance practicing machine according to claim 1, wherein an elevator mechanism is provided to raise and lower said seat.

16. The balance practicing machine according to claim 15, wherein said elevator is repeatedly raised and lowered during operation of said drive mechanism to provide compound motion to said seat.

17. The balance practicing machine according to claim 1, wherein the swinging motion comprises three degrees of freedom of movement to the seat in the form of a longitudinal (forward and backward) reciprocating linear motion and reciprocating pivoting motions around a fore-aft (longitudinal) and traverse axes.

18. The balance practicing machine according to claim 1, wherein the expandable and contractible member is provided integrally with the balance practicing machine.

19. A balance practicing machine comprising:

a seat;

a drive mechanism that imparts a swinging motion to said seat; and a moving device that is repeatedly actuated during operation of said drive mechanism to provide compound motion to said seat, wherein said moving device comprises:

an expandable and contractible member provided at a location of said seat corresponding to thighs of the user sitting on said seat; and a mechanism that automatically repeatedly expands and contracts said expandable and contractible member in alternately repeating upwardly-outwardly and downwardly-inwardly directions during operation of the drive mechanism to provide compound motion to the seat.

20. The balance practicing machine according to claim 19, further comprising:

an elevator mechanism provided to raise and lower said seat;

wherein said elevator is repeatedly raised and lowered during operation of said drive mechanism to provide additional compound motion to said seat.

21. The balance practicing machine according to claim 19, wherein the swinging motion comprises three degrees of freedom of movement to the seat in the form of a longitudinal (forward and backward) reciprocating linear motion and reciprocating pivoting motions around a fore-aft (longitudinal) and traverse axes.

22. The balance practicing machine according to claim 19, wherein the expandable and contractible member is provided integrally with the balance practicing machine.

* * * * *